US010608392B2

(12) United States Patent
Duan et al.

(10) Patent No.: US 10,608,392 B2
(45) Date of Patent: Mar. 31, 2020

(54) ELECTRICAL CONNECTOR ASSEMBLY

(71) Applicant: Advanced Connectek Inc., New Taipei (TW)

(72) Inventors: Shu-Lin Duan, New Taipei (TW); Wei Wan, New Taipei (TW); Hua-Yan Wu, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 0 days.

(21) Appl. No.: 16/186,489

(22) Filed: Nov. 10, 2018

(65) Prior Publication Data

US 2019/0157823 A1 May 23, 2019

(30) Foreign Application Priority Data

Nov. 17, 2017 (CN) ..... 2017 2 1536172 U

(51) Int. Cl.

| | |
|---|---|
| ***H01R 13/6588*** | (2011.01) |
| ***H01R 13/6594*** | (2011.01) |
| ***H01R 27/02*** | (2006.01) |
| ***H01R 12/71*** | (2011.01) |
| ***H01R 13/502*** | (2006.01) |
| ***H01R 25/00*** | (2006.01) |
| *H01R 13/627* | (2006.01) |
| *H01R 13/46* | (2006.01) |

(Continued)

(52) U.S. Cl.

CPC ..... *H01R 27/02* (2013.01); *H01R 12/716* (2013.01); *H01R 13/502* (2013.01); *H01R 13/6588* (2013.01); *H01R 25/00* (2013.01); *H01R 13/465* (2013.01); *H01R 13/6272* (2013.01); *H01R 13/631* (2013.01); *H01R 13/64* (2013.01); *H01R 13/6585* (2013.01); *H01R 13/6594* (2013.01); *H01R 2107/00* (2013.01)

(58) Field of Classification Search

CPC ..... H01R 27/02; H01R 12/716; H01R 25/00; H01R 13/502; H01R 13/6588; H01R 13/465; H01R 13/6272; H01R 13/631

See application file for complete search history.

(56) References Cited

U.S. PATENT DOCUMENTS 3,128,138 A * 4/1964 Noschese ..... H01R 13/648 439/579
3,566,334 A * 2/1971 Ziegler, Jr. ..... H01R 24/52 439/248

(Continued)

FOREIGN PATENT DOCUMENTS

| | | |
|---|---|---|
| CN | 101359797 | 2/2009 |
| CN | 102396118 | 3/2012 |

*Primary Examiner* — Edwin A. Leon
*Assistant Examiner* — Milagros JeanCharles
(74) *Attorney, Agent, or Firm* — JCIPRNET

(57) ABSTRACT

An electrical connector assembly including a plug electrical connector and a receptacle electrical connector is provided. The plug electrical connector includes a first structural member and a plurality of first terminals, and the first terminals are disposed in the first structural member. The receptacle electrical connector includes a second structural member and a plurality of second terminals, and the second terminals are disposed in the second structural member. The first structural member is adapted for docking with the second structural member such that the first terminals are correspondingly inserted and electrically connected to the second terminals.

15 Claims, 10 Drawing Sheets

(51) Int. Cl.

| | |
|---|---|
| *H01R 13/631* | (2006.01) |
| *H01R 13/64* | (2006.01) |
| *H01R 107/00* | (2006.01) |
| *H01R 13/6585* | (2011.01) |

(56) References Cited

U.S. PATENT DOCUMENTS 4,808,125 A * 2/1989 Waters ..... H01R 23/6873 439/607.27
4,824,398 A * 4/1989 Taylor ..... H01R 13/6595 439/557
4,943,244 A * 7/1990 Teck ..... H01R 23/7073 439/567
5,890,923 A * 4/1999 Wright ..... H01R 13/74 248/56
6,744,639 B1 * 6/2004 Branch ..... G02B 6/4277 361/753
7,347,745 B1 * 3/2008 Raudenbush ..... H01R 13/4223 439/595
7,377,808 B2 * 5/2008 Gentry ..... H01R 13/521 439/578
7,704,077 B1 * 4/2010 Morley ..... H01R 24/50 439/63
7,909,612 B2 * 3/2011 Steinkamp ..... H01Q 1/3275 439/63
8,029,324 B1 * 10/2011 Yi ..... H01R 13/518 439/745
9,735,519 B2 * 8/2017 Yi ..... H01R 9/05
9,882,317 B1 * 1/2018 Lane ..... H01R 13/4223
2006/0110978 A1 * 5/2006 Fan ..... H01R 13/514 439/607.01
2009/0130902 A1 * 5/2009 Hall ..... H01R 13/4361 439/595
2010/0062638 A1 * 3/2010 Benham ..... H01R 23/688 439/578
2018/0026392 A1 * 1/2018 Panitz ..... H01R 13/42 439/170

* cited by examiner

20

ELECTRICAL CONNECTOR ASSEMBLY

CROSS-REFERENCE TO RELATED APPLICATION

This application claims the priority benefit of China patent application serial no. 201721536172.6, filed on Nov. 17, 2017. The entirety of the above-mentioned patent application is hereby incorporated by reference herein and made a part of the specification.

BACKGROUND OF THE INVENTION

1. Field of the Invention

The invention relates to an electrical connector assembly.

2. Description of Related Art

In the past, connectors for cable-connected to printed-circuit board (PCB) are standardized according to various systems. In the automotive technology, a system called FAKRA (Fachkreis Automobiltechnik) is known as a standard adapted in Europe and the United States. FAKRA represents an automotive standard committee (Normenausschuss Kraftfahrzeuge) within the German Institute of Standardization that concerns international standardization of the automotive industry. A standard promoted by FAKRA is named FAKRA standard (which adopts the name of the organization that establishes the standard system), and is generally used in automotive applications, such as GPS, AM/FM radio, mobile phones, airbag systems, and multimedia devices.

In general, FAKRA standard is to provide a connector system that utilizes key and color codes. Because the same type of keys can only be connected to a corresponding key slot in the FAKRA connector, various connectors with different keys or colors have been provided for applications in electronic devices of different types or functions.

However, this situation will require manufacturers to develop corresponding molds and material for each type of the connector. Also, it is also required to install each of the connectors one by one in the assembly process to cause assembly difficulties and inefficiency. Furthermore, various types of connectors are also prone to considerable burdens on production management, such as inventory management, and thus increase production costs.

Accordingly, how to provide a simple connector structure to overcome the above situation is actually an issue to be addressed by persons skilled in the art.

SUMMARY OF THE INVENTION

In view of the above problems, the invention provides an electrical connector assembly, in which a plug electrical connector and a receptacle electrical connector respectively include an integrated terminal set, which facilitates manufacturing and management and simplifies the assembly process.

An electrical connector assembly of the invention includes a plug electrical connector and a receptacle electrical connector. The plug electrical connector includes a first structural member and a plurality of first terminals, and the first terminals are disposed in the first structural member. The receptacle electrical connector includes a second structural member and a plurality of second terminals, and the second terminals are disposed in the second structural member. The first structural member is adapted for docking with the second structural member such that the first terminals are respectively and correspondingly inserted and electrically connected to the second terminals, wherein each of the first terminals and the second terminals is compliant with a specification of a SMB RF connector of Fachkreis Automobiltechnik (FAKRA).

In an embodiment, a number of the first terminals and a number of the second terminals are respectively M, and a number of types of the first terminals and a number of types of the second terminals are respectively N, where $1 \leq N \leq M$.

In an embodiment, the first structural member includes a first body and a front cover. The first body has a plurality of first inserting holes, and the first terminals are respectively accommodated within the first inserting holes. The front cover covers a part of the first body.

In an embodiment, the electrical connector assembly further comprises a circuit board overlaid by the front cover such that the part of the first body is located therein, and the first terminals respectively are inserted and electrically connected to the circuit board.

In an embodiment, the first body includes a first base, a side wall, and a plurality of first protrusions. The side wall and the first protrusions are extended from the first base in a same direction. Each of the insertion holes penetrates the first base and the first protrusions. The front cover covers the first base, the side wall and the first protrusions penetrate the front cover and are protruded out of the front cover.

In an embodiment, the first body has an engaging recess to be engaged with an engaging point of the second structural member so as to hold the first body and the second structural member together.

In an embodiment, the second structural member includes a second body, a first shielding shell and a plurality of second shielding shells. The second body has a plurality of second inserting holes, and the second terminals are respectively being accommodated within the second inserting holes. The first shielding shell disposed surrounding the second body. The second shielding shells respectively assembled to the second body and corresponding to the second terminals, any adjacent two of the second terminals are spaced apart by the second shielding shell.

In an embodiment, the second body has a positioning protrusion and a locking groove, the first shielding shell has a positioning groove and a locking protrusion, the second body and the first shielding shell are positioned together by the positioning protrusion and the positioning groove, and the second body and the first shielding shell are held together by the locking groove and the locking protrusion.

In an embodiment, the second body includes a second base, a side wall and a plurality of second protrusions extended from the second base. Each of the second inserting holes penetrates the second base and each of the second protrusions, and the second shielding shells surrounds the second protrusions respectively.

In an embodiment, the second base further comprises a plurality third insertion holes. Each of the second shielding shells has a sleeve and a pair of pins, the sleeves are sleeved on the second protrusions, and the pair of pins are extended from the sleeve and inserted to the third inserting holes.

In an embodiment, the first shielding shell has an engaging point for engaging with an engaging recess of the first structural member so as to hold the first shielding shell and the first structural member together.

In an embodiment, the first structural member includes a first body and a front cover. The first body has a plurality of first inserting holes, and the first terminals are respectively inserted to the first inserting holes. The front cover covers a part of the first body.

In an embodiment, a circuit board is further included and overlaid by the front cover such that the part of the first body is located therein. The first terminals are respectively inserted and electrically connected to the circuit board.

In an embodiment, the first body has a first base and a first side wall, the first side wall is extended from the first base, the first base has the first inserting holes; and a part of each of the first terminals passes through the first inserting hole correspondingly and is surrounded by the first side wall.

In an embodiment, the first body has a guiding groove and a bump, respectively engaged with a guiding rib and a clamping piece to position and hold the first body and the second structural member together.

In an embodiment, the second structural member includes a second body having a second base and a second side wall, the second side wall is extended from the second base, the second base has the second inserting holes; and the second terminals pass through the second base and being surrounded by the second side wall.

In an embodiment, the second body further includes a guiding rib located on the second side wall, and the guiding rib is guided by and engaged with a guiding groove of the first structural member such that the second body is inserted to the first structural member.

In an embodiment, the second body further includes a clamping piece disposed on the second base and suspended on the second side wall, and the guiding piece and a bump of the first structural member are engaged with each other to hold the second body on the first structural member.

Based on the above, owing to multiple specifications, the manufacturing process and assembly of the FAKRA SMB connector may show poor performance due to complicated processes. Therefore, the invention includes an integrated terminal set (i.e., with the terminals of required specifications integrated together through the structural members). In this way, after modularizing the plug electrical connector and the receptacle electrical connector, the electrical connection effect may be completed for the terminals with various specifications simply by the one-time docking action. At the same time, with a single structure produced from said modularization, not only can costs be reduced since the manufacturing process in terms of molds, materials, etc., can be simplified, the management burden may also be substantially reduced by the simplified manufacturing process.

To make the above features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
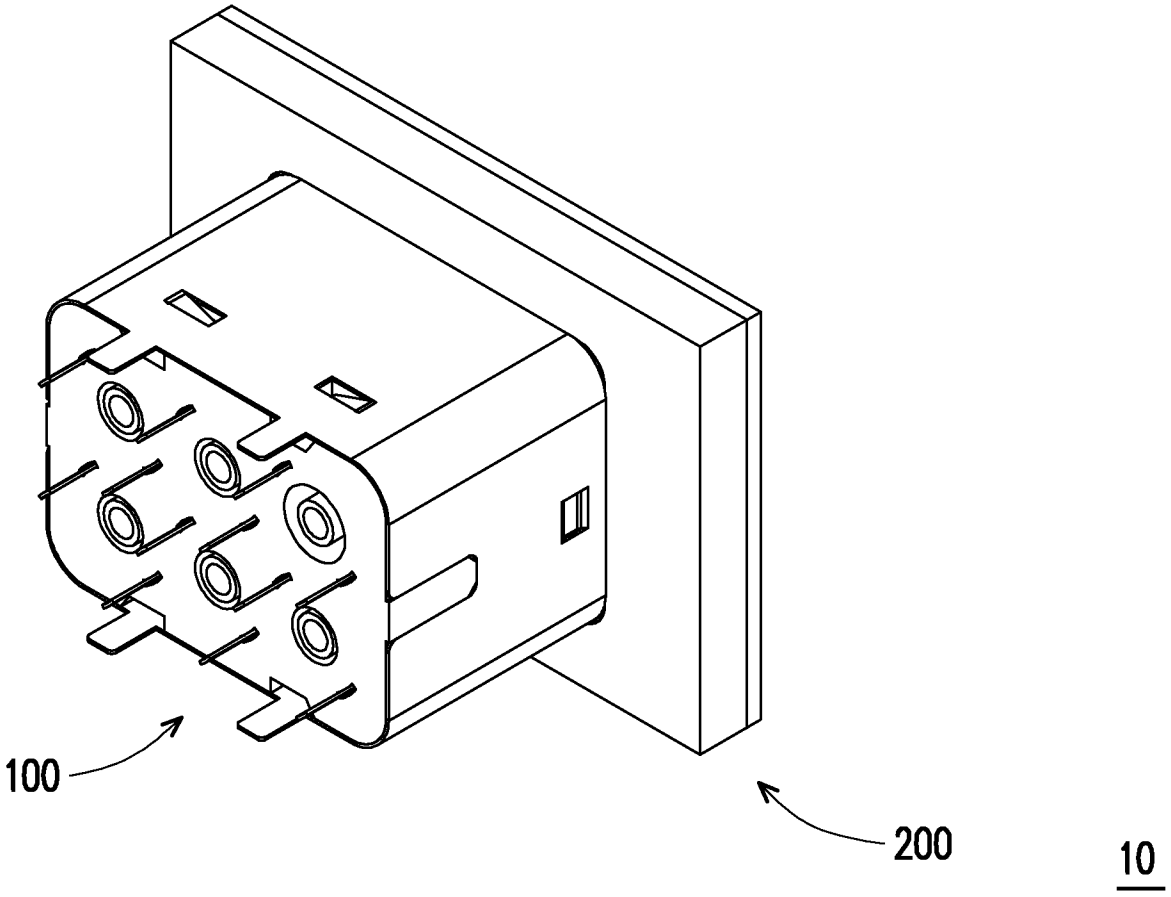
FIG. 1 is a schematic view of an electrical connector assembly according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
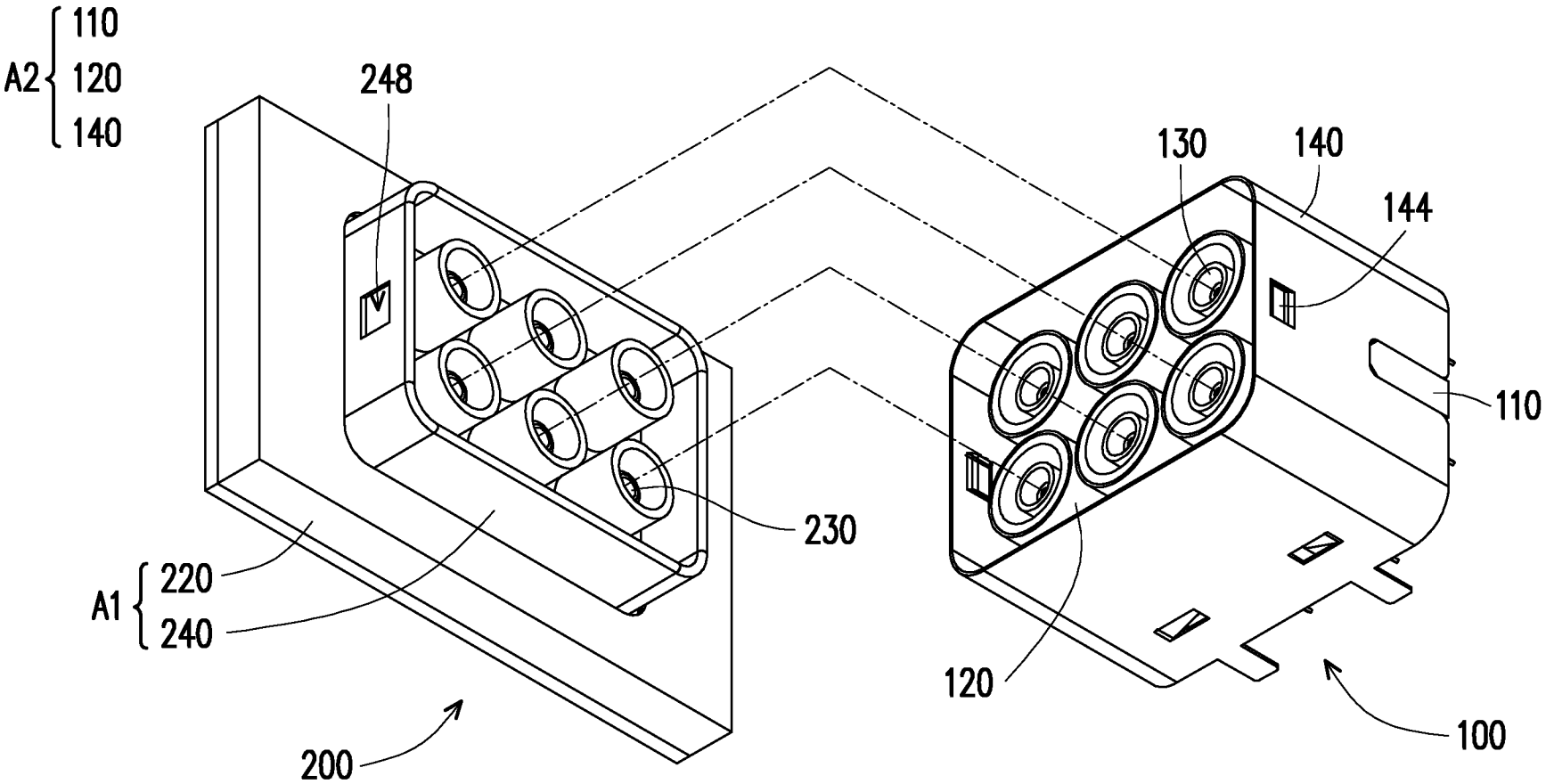
FIG. 2 is a schematic view for assembling the electrical connector assembly of FIG. 1.

FIG. 1 is a schematic view of an electrical connector assembly according to an embodiment of the invention. FIG. 2 is a schematic view for assembling the electrical connector assembly of FIG. 1. Referring to FIG. 1 and FIG. 2 together, in this embodiment, an electrical connector assembly 10 includes a plug electrical connector 200 and a receptacle electrical connector 100. The plug electrical connector 200 includes a first structural member A1 and a plurality of first terminals 230, and the first terminals 230 are disposed in the first structural member A1. The receptacle electrical connector 100 includes a second structural member A2 and a plurality of second terminals 130, and the second terminals 130 are disposed in the second structural member A2. Here, the first terminals 230 may be inserted to the second terminals 130 to achieve electrical connection via one-step assembly process of mutually assembling the first structural member A1 and the second structural member A2.

More specifically, the first terminals 230 and the second terminals 130 of this embodiment are compliant with a specification of a SMB RF connector of Fachkreis Automobiltechnik (FAKRA). In other words, each of the plug electrical connector 200 and the receptacle electrical connector 100 is the FAKRA SMB connector. A number of the first terminals 230 and a number of the second terminals 130 are respectively M, and a number of types of the first terminals 230 and a number of types of the second terminals 130 are respectively N, where $1 \leq N \leq M$ and each of N and M is a positive integer. For instance, six different first terminals 230 (or second terminals 130) are used to form an integrated structure (M=6) in this embodiment. These six first terminals 230 (or the second terminals 130) may be terminals belonging to one single specification (N=1) or may be terminals having types different from one another (N=6). Here, the number and the number of types of the terminals are not particularly limited, i.e., those who meet the above conditions can all be applied to this embodiment.

As described above, FAKRA standard is to provide a connector system that utilizes key and color codes. Therefore, there are various connectors with specifications (colors) of different types. Consequently, such diversification would lead to inconvenience and burden on production, management, and assembly.

Accordingly, this embodiments of the invention provide an integrated terminal set by selecting required terminals and performing a modularization on them. In this way, the electrical connection may be completed for the terminals with various specifications simply via one-step docking process. At the same time, with a single structure produced from said modularization, not only can costs be reduced since the manufacturing process in terms of molds, materials, etc., can be simplified, the management burden may also be substantially reduced by the simplified manufacturing process.

Figure 3:
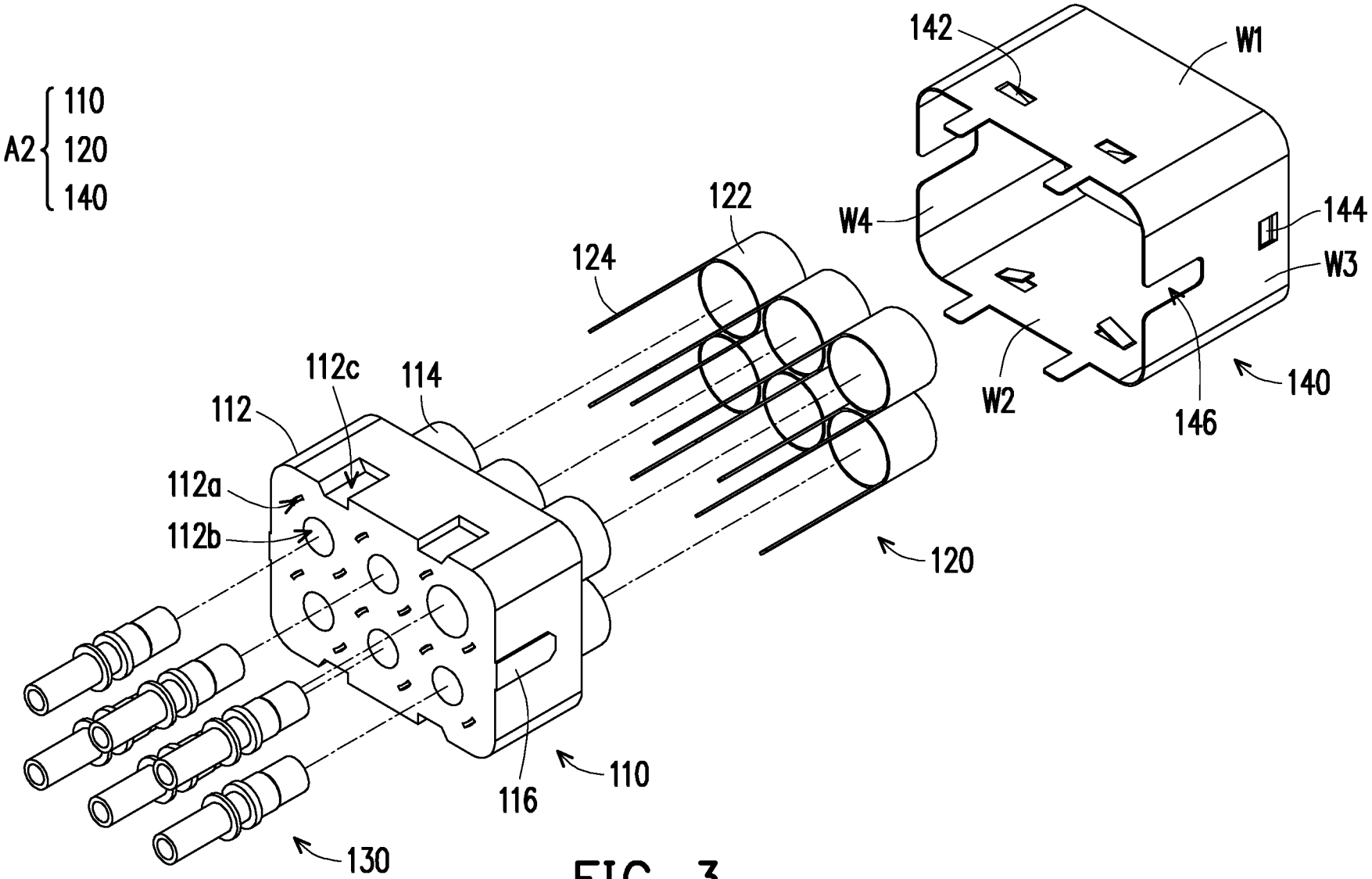
FIG. 3 is an explosion view of a receptacle electrical connector.

FIG. 3 is an explosion view of a receptacle electrical connector. Referring to FIG. 2 and FIG. 3 together, in this embodiment, the second structural member A2 of the receptacle electrical connector 100 includes a second body 110, a first shielding shell 140 and second shielding shells 120. The second body 110 includes a second base 112 and a plurality of second protrusions 114 extended from the second base 112. The second body 110 has a plurality of second inserting holes 112*b*, penetrating the second base 112 and the second protrusions 114. The second terminals 130 are inserted to the second inserting holes 112*b* and substantially located in the second base 112 and the second protrusions 114. The first shielding shell 140 is disposed and surrounding the second body 110. The second shielding shells 120 are respectively assembled to the second body 110 such that any adjacent two of the second terminals 130 are spaced apart by the second shielding shell 120.

More specifically, the second body 110 has a positioning protrusion 116 and a locking groove 112*c*, and the first shielding shell 140 has a positioning groove 146 and a locking protrusion 142. The first shielding shell 140 is composed of, for example, four side walls W1, W2, W3 and W4 connected in from of ring. The positioning groove 146 is located on the side walls W3 and W4, and the locking protrusion 142 is located on the side walls W1 and W2. Therefore, the second body 110 and the first shielding shell 140 are positioned together by the positioning protrusion 116 and the positioning groove 146, and the second body 110 and the first shielding shell 140 are held together by the locking groove 112*c* and the locking protrusion 142. Furthermore, as shown in FIG. 3, each of the second shielding shells 120 is disposed and surrounding the corresponding second protrusion 114. More specifically, the second shielding shell 120 has a sleeve 122 and a pair of pins 124. The sleeves 122 are sleeved on the second protrusions 114, and the pins are extended from the sleeve 122 and inserted to third inserting holes 112*a* on the second base 112 so the second shielding shell 120 can be successfully secured on the second body 110. Accordingly, the receptacle electrical connector 100 is able to maintain favorable electromagnetic shielding effect with peripheral electronic components through the first shielding shell 140 so the receptacle electrical connector 100 and peripheral electronic components can operate independently without producing mutual electromagnetic interference. At the same time, with the presence of the second shielding shell 120, the electromagnetic shielding effect may be kept between the second terminals 130 so each of the second terminals 130 can transmit data without suffering mutual electromagnetic interference.

Figure 4:
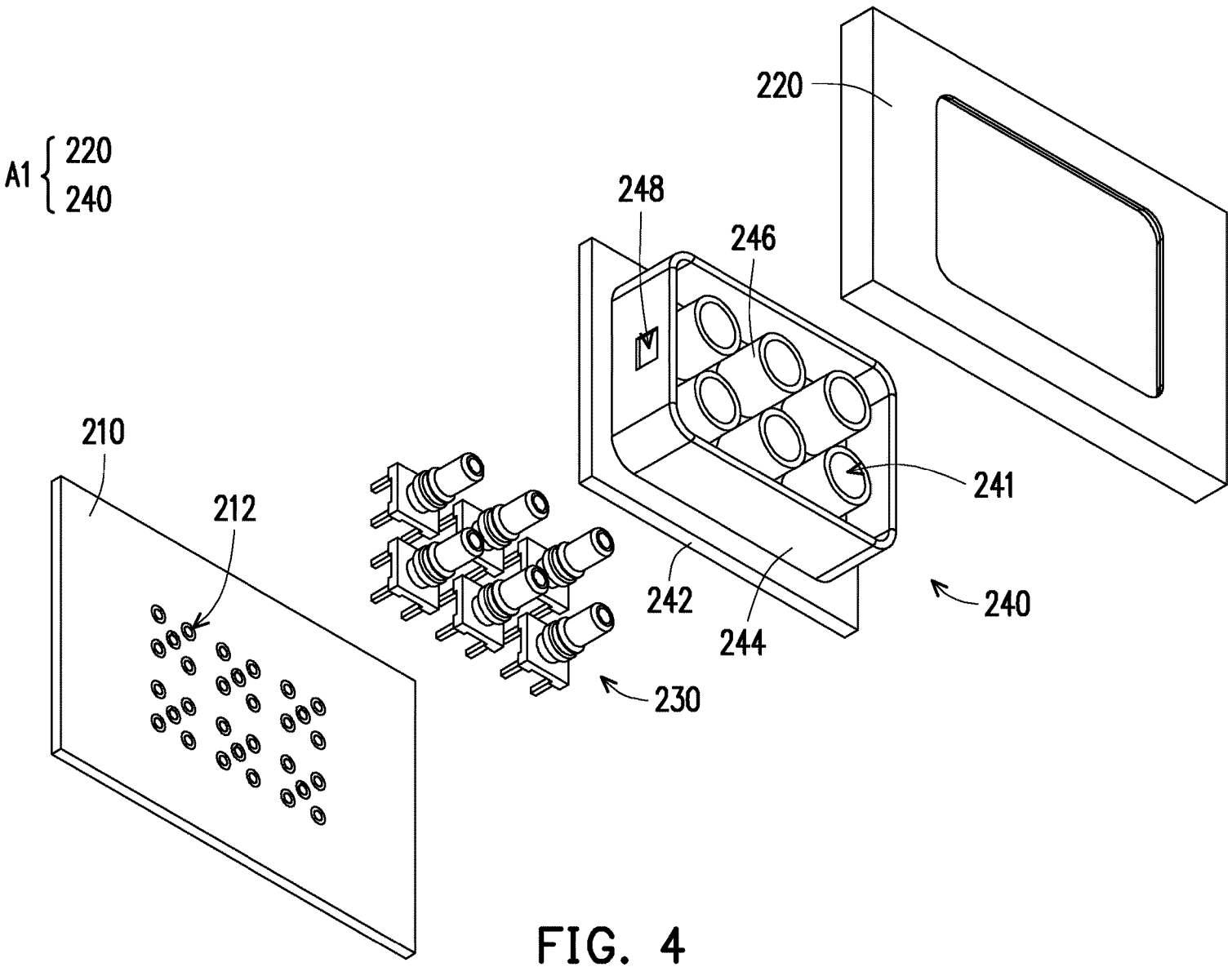
FIG. 4 is an explosion view of a plug electrical connector.

FIG. 4 is an explosion view of a plug electrical connector. With reference to FIG. 4, the first structural member A1 includes a first body 240 and a front cover 220. The first body 240 has a plurality of first inserting holes 241. The first terminals 230 are inserted to the first inserting holes 241, and the front cover 220 covers a part of the first body 240. More specifically, the first body 240 includes a first base 242, a side wall 244 and a plurality of first protrusions 246. The side wall 244 and the first protrusions 246 are extended from the first base 242 in a same direction, and the side wall 244 surrounds the first protrusion 246. Each of the first inserting holes 241 penetrates the first base 242 and each of the first protrusions 246, and the front cover 220 covers the first base 242 such that the side wall 244 and the first protrusions 244 pass through the front cover 220. Furthermore, the electrical connector assembly 10 further includes a circuit board 210, which is overlaid by the front cover 220 such that the part of the first body 240 is located therein, and the first terminals 230 are respectively inserted and electrically connected to pads 212 of the circuit board 210.

Referring back to FIG. 2, in this embodiment, the first terminals 230 are modularized into the plug electrical connector 200, and the second terminals 130 are modularized into the receptacle electrical connector 100. In this way, rather than connecting the first terminals 230 and the second terminals 130 one by one, the user may have the first terminals 230 and the second terminals 130 correspondingly and electrically connected to one another simply by performing the one-time docking action on the first structural member A1 and the second structural member A2. Moreover, in the first structural member A1, the first body 240 has an engaging recess 248; and in the second structural member A2, the first shielding shell 140 has an engaging point 144. Accordingly, the plug electrical connector 200 and the receptacle electrical connector 100 may be connected together securely through the mutual cooperation of the engaging recess 248 and the engaging point 144.

Figure 5:
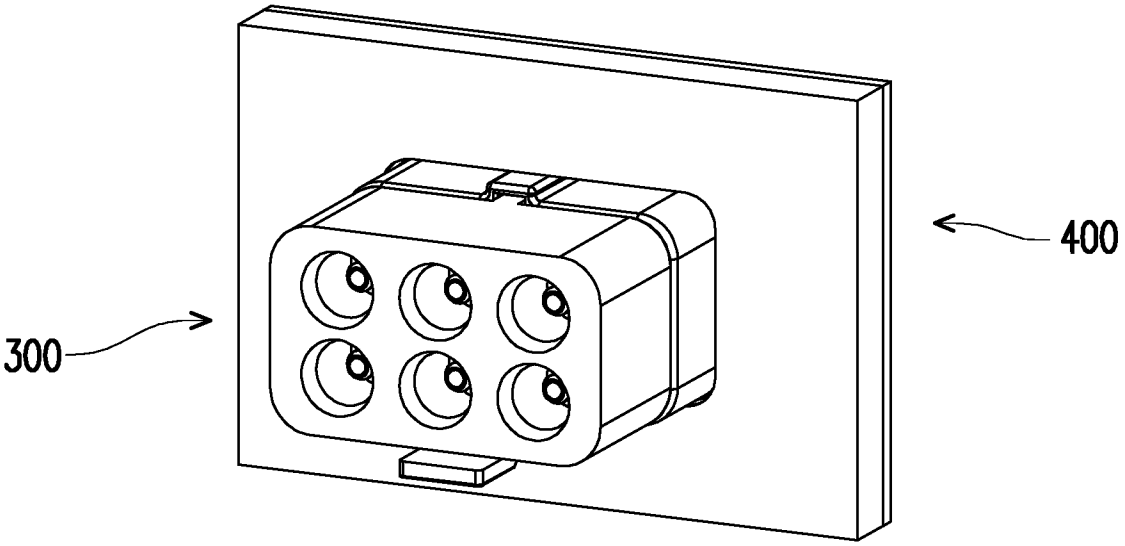
FIG. 5 is a schematic view of an electrical connector assembly according to another embodiment of the invention.
Figure 6:
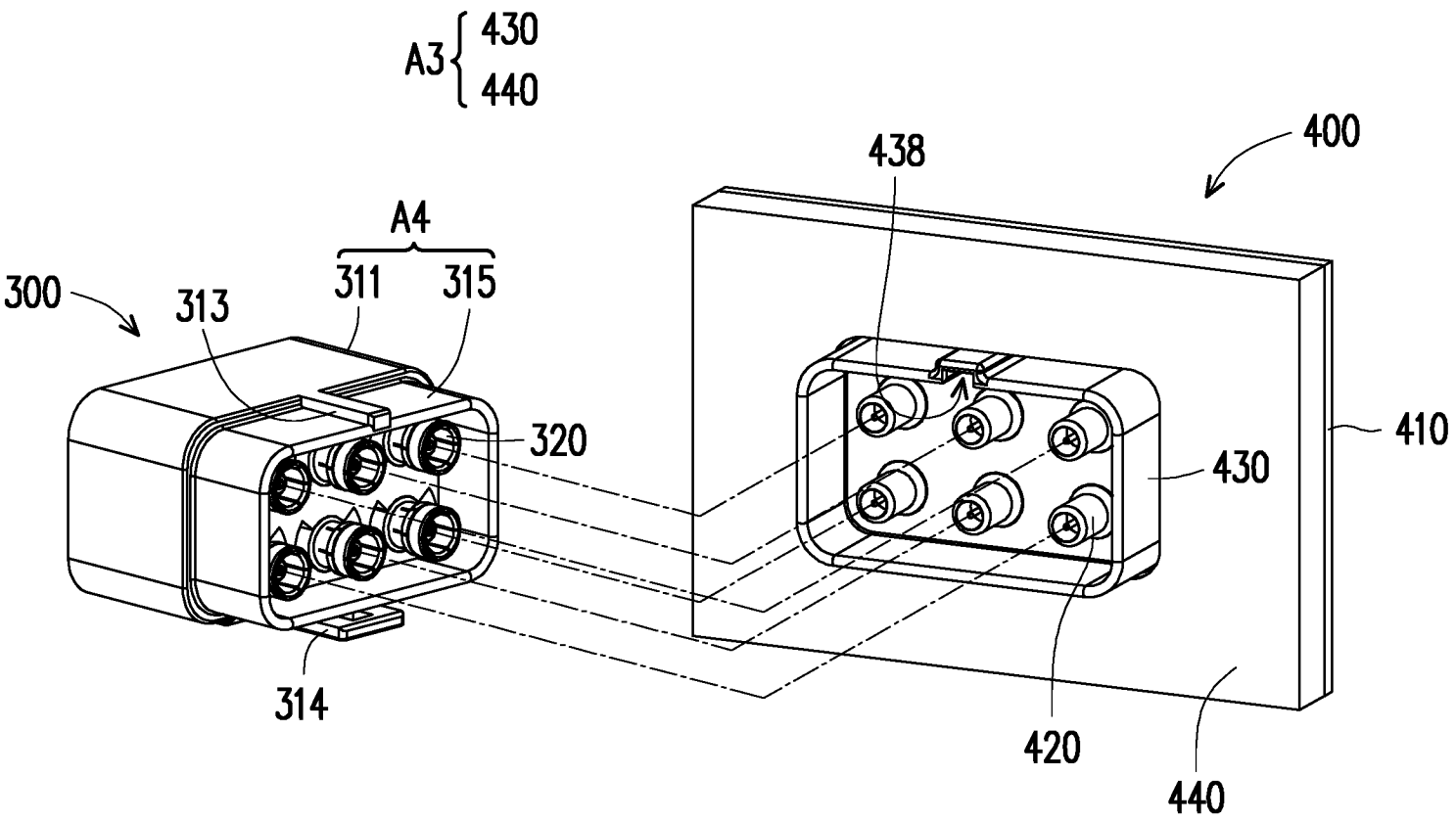
FIG. 6 and FIG. 7 are schematic views for assembling the electrical connector assembly of FIG. 5.
Figure 7:
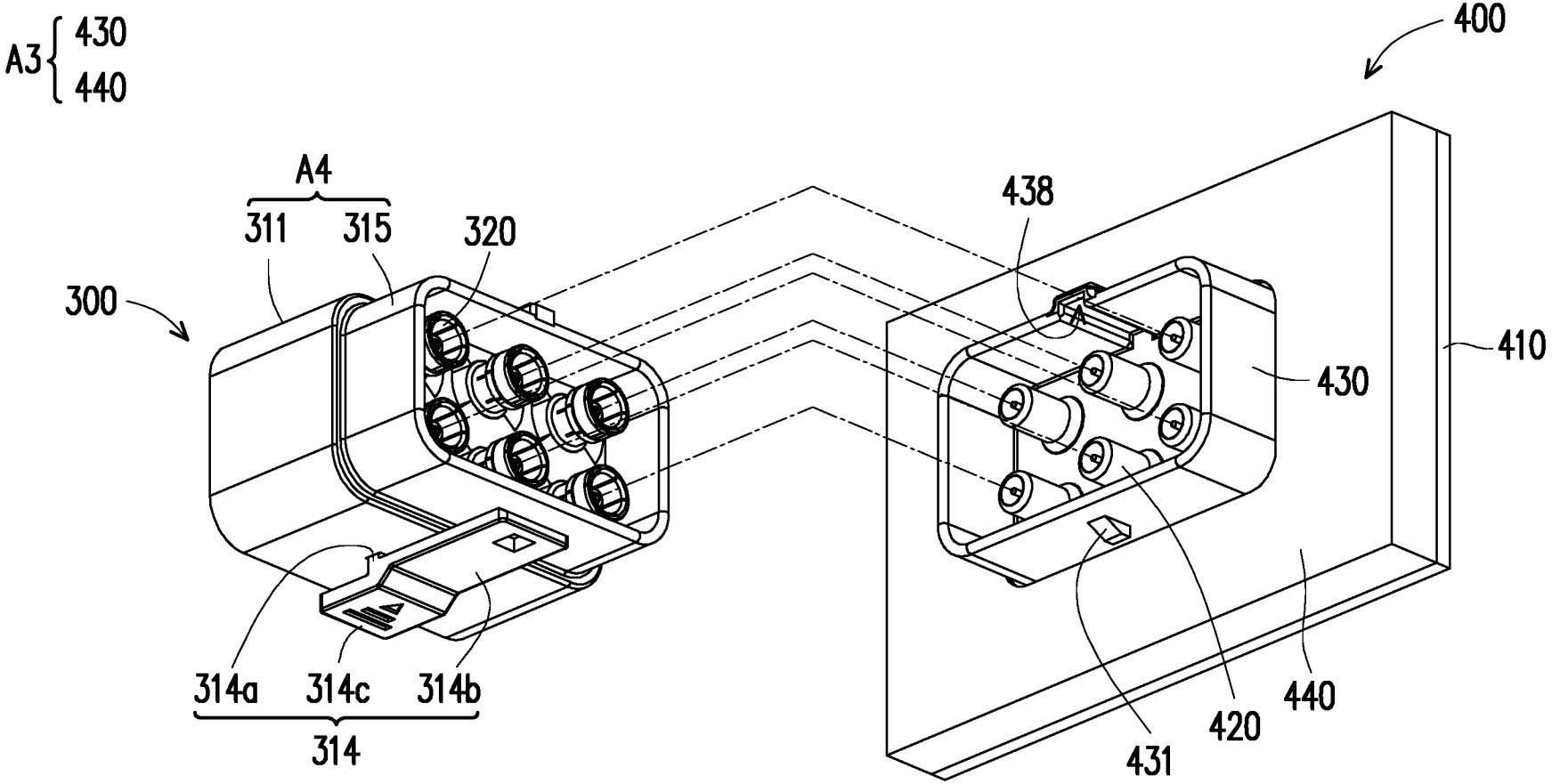

FIG. 5 is a schematic view of an electrical connector assembly according to another embodiment of the invention. FIG. 6 and FIG. 7 are schematic views for assembling the electrical connector assembly of FIG. 5. Referring to FIG. 5 to FIG. 7, in this embodiment, an electrical connector assembly 20 includes a plug electrical connector 400 and a receptacle electrical connector 300. The plug electrical connector 400 includes a first structural member A3 and a plurality of first terminals 420, and the receptacle electrical connector 300 includes a second structural member 310 and a plurality of second terminals 320.

Figure 8:
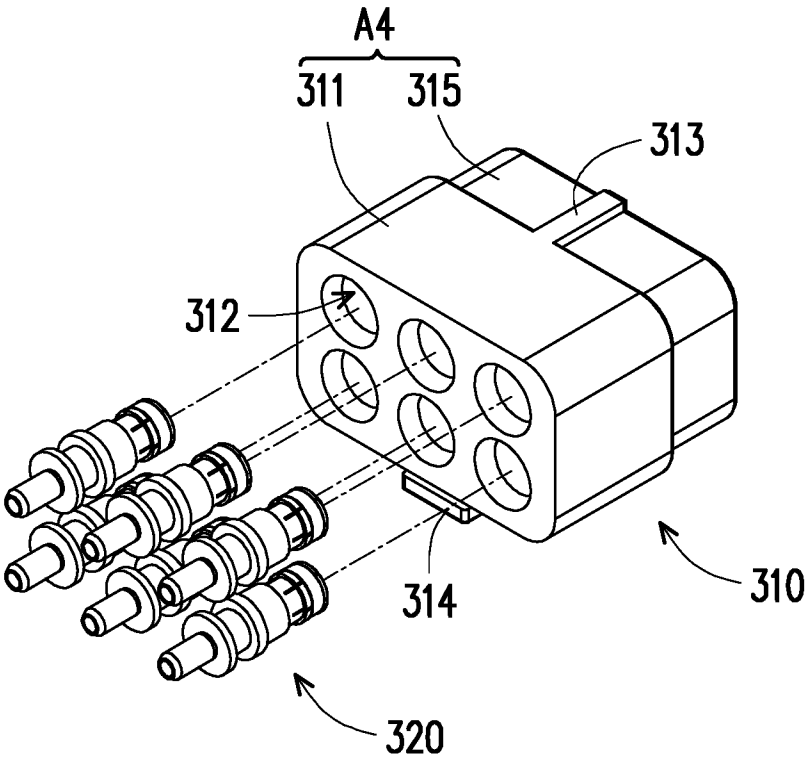
FIG. 8 is an explosion view of a receptacle electrical connector.

FIG. 8 is an explosion view of a receptacle electrical connector. Referring to FIG. 7 and FIG. 8 together, in this embodiment, the second structural member 310 of the receptacle electrical connector 300 includes a second body A4, and the second body A4 is further divided into the second base 311 and a second side wall 315. The second side wall 315 is extended from the second base 311; the second base 311 has a plurality of second inserting hole 312 for the second terminals 320 being accommodated therein; and parts of the second terminals 320 passed outside the second base 311 are surrounded by the second side wall 315, as shown in FIG. 7.

Figure 9:
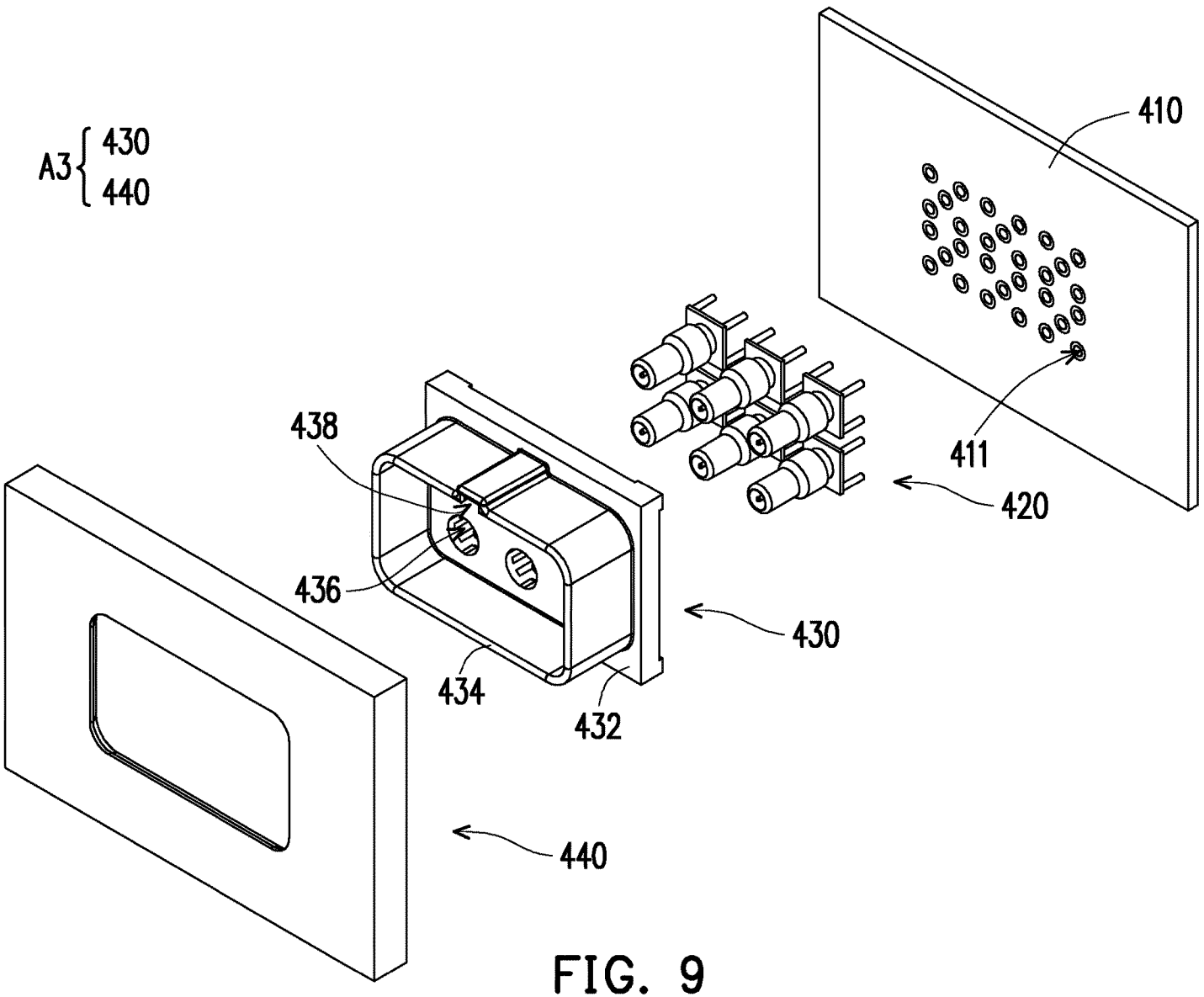
FIG. 9 is an explosion view of a plug electrical connector.

FIG. 9 is an explosion view of a plug electrical connector. Referring to FIG. 6, FIG. 7 and FIG. 9 together, in this embodiment, the first structural member A3 includes a first body 430 and a front cover 440, and the first body 430 has a plurality of first inserting holes 436 for respectively inserting the first terminals 420 to the first inserting holes 436. The front cover 440 is used to cover a part of the first body 430. More specifically, the first body 430 has a first base 432 and a first side wall 434; the first side wall 434 is extended from the first base 432; the first base 432 has the first inserting holes 436 described above; and a part of each of the first terminals 420 passes through the first inserting hole 436 and is surrounded by the first side wall 434, as shown in FIG. 6 or FIG. 7. Furthermore, the electrical connector assembly 20 further includes a circuit board 410, which is overlaid by the front cover 440 such that the part of the first body 430 is located therein, and the first terminals 420 are respectively inserted and electrically connected to pads 411 of the circuit board 410.

Figure 10:
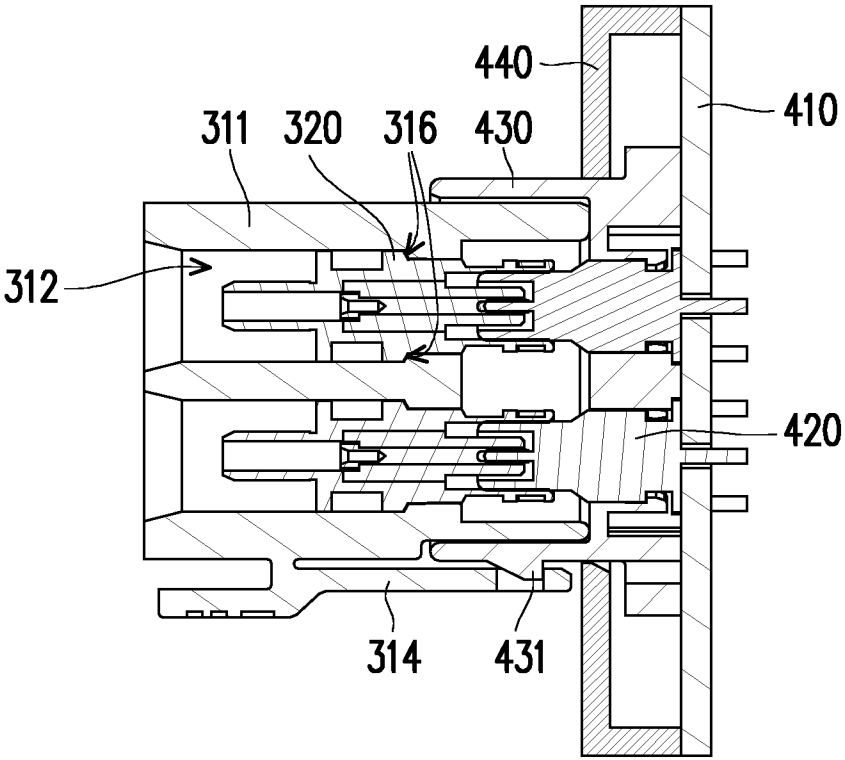
FIG. 10 is a cross-sectional view of the electrical connector assembly of FIG. 5.

FIG. 10 is a cross-sectional view of the electrical connector assembly of FIG. 5. Referring to FIG. 6, FIG. 7 and FIG. 10, in this embodiment, the first body 430 has a guiding groove 438 and a bump 431, which are respectively used to engage with a guiding rib 313 and a clamping piece 314 of the second structural member 310 to position and hold the first body 430 and the second structural member 310 together. More specifically, the second structural member 310 has the guiding rib 313 located on the second side wall 315, which may be guided by and engaged with the guiding groove 438 on the first side wall 434 to provide a positioning effect in the process of inserting the second body A4 to the first structural member A3. At the same time, the second structural member 310 further includes the clamping piece 314, which is disposed on the second base 311 and extended and suspended on the second side wall 315, as shown in FIG. 7 and FIG. 10. The clamping piece 314 includes a supporting point 314*a*, a pressing part 314*c* and a clamping part 314*b*. The supporting point 314*a* is connected to the second base 311 of the second body A4 and located between the pressing part 314*c* and the clamping part 314*b*. In other words, the pressing part 314*c* and the clamping part 314*b* are extended form the supporting point 314*a* respectively in opposite directions. The pressing part 314*c* is suspended on the second base 311, and the locking 314*b* is suspended on the second side wall 315. In this way, the clamping piece 314 is adapted to engage with the bump 431 of the first structural member A3 to hold the second body A4 on the first structural member A3. Conversely, the user may apply force to the pressing part 314*c* to release the coupling relationship between the clamping part 314*b* and the bump 431, so as to easily detach the plug electrical connector 400 and the receptacle electrical connector 300 from each other. In addition, the clamping piece 314 and the bump 431 disposed on one single side of the structural member may also provide an anti-misinsertion effect when docking with the connector.

It should be noted that, referring back to FIG. 10, while being assembled to the second inserting holes 312, the second terminals 320 can successfully produce a structural interference with the second structural member 310 through pushing parts 316 of the second structural member 310 located in the second inserting holes 312 to be positioned and secured inside the second structural member 310.

In summary, in the foregoing embodiments of the invention, in order to provide a more efficient manufacturing and usage conditions for the SMB RF connectors compliant with Fachkreis Automobiltechnik (FAKRA), the electrical connector assembly of the invention includes the plug electrical connector and the receptacle electrical connector, which are respectively formed by modularizing the first terminals and the second terminals of the required specification. In other words, to improve the production and assembly efficiency, the terminals of the required specifications are integrated together through the structural members in advance, so as to form the integrated terminal set. In this way, the electrical connection effect may be completed for the terminals with various specifications simply through the one-time docking action. At the same time, with a single structure produced from the modularization, not only can costs be reduced by simplifying the manufacturing process in terms of molds, materials, etc., the management burden may also be substantially reduced by the simplified manufacturing process.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An electrical connector assembly, comprising:

a plug electrical connector, comprising a first structural member and a plurality of first terminals, the first terminals being disposed in the first structural member; and a receptacle electrical connector, comprising a second structural member and a plurality of second terminals, wherein the second terminals are disposed in the second structural member, and the first structural member is adapted for docking with the second structural member such that the first terminals are respectively inserted and electrically connected to the second terminals, wherein the second structural member comprises:

a second body having a plurality of second inserting holes, and the second terminals are respectively accommodated within the second inserting holes; and a plurality of second shielding shells, respectively assembled to the second body and corresponding to the second terminals, any adjacent two of the second terminals being spaced apart by the second shielding shell, wherein the second body comprises a second base and a plurality of second protrusions extended from the second base, each of the second inserting holes penetrates the second base and each of the second protrusions, and the second shielding shells are respectively disposed surrounding the second protrusions.

2. The electrical connector assembly as recited in claim 1, wherein a number of the first terminals and a number of the second terminals are respectively M, and a number of types of the first terminals and a number of types of the second terminals are respectively N, where $1 \leq N \leq M$.

3. The electrical connector assembly as recited in claim 1, wherein the first structural member comprises:

a first body, having a plurality of first inserting holes, the first terminals respectively being accommodated within the first inserting holes; and a front cover, covering a part of the first body.

4. The electrical connector assembly as recited in claim 3, further comprising:

a circuit board, overlaid by the front cover such that the part of the first body is located therein, the first terminals respectively being inserted and electrically connected to the circuit board.

5. The electrical connector assembly as recited in claim 3, wherein the first body comprises a first base, a side wall and a plurality of first protrusions, the side wall and the first protrusions are extended from the first base in the same direction, the side wall surrounds the first protrusions, each of the first inserting holes penetrates the first base and each of the first protrusions, and the front cover covers the first base such that the side wall and the first protrusion pass through the front cover.

6. The electrical connector assembly as recited in claim 3, wherein the first body has an engaging recess for engaging with an engaging point of the second structural member to hold the first body and the second structural member together.

7. The electrical connector assembly as recited in claim 3, wherein the first body has a first base and a first side wall, the first side wall is extended from the first base, the first base has the first inserting holes, and a part of each of the first terminals passes through and extends out of the first inserting hole and is surrounded by the first side wall.

8. The electrical connector assembly as recited in claim 3, wherein the first body has a guiding groove and a bump, respectively engaged with a guiding rib and a clamping piece to position and hold the first body and the second structural member together.

9. The electrical connector assembly as recited in claim 1, wherein the second structural member further comprises:

a first shielding shell, disposed surrounding the second body.

10. The electrical connector assembly as recited in claim 9, wherein the second body has a positioning protrusion and a locking groove, the first shielding shell has a positioning groove and a locking protrusion, the second body and the first shielding shell are positioned together by the positioning protrusion and the positioning groove, and the second body and the first shielding shell are held together by the locking groove and the locking protrusion.

11. The electrical connector assembly as recited in claim 9, wherein the first shielding shell has an engaging point for engaging with an engaging recess of the first structural member to hold the first shielding shell and the first structural member together.

12. The electrical connector assembly as recited in claim 1, wherein the second base further comprises a plurality of third inserting holes, each of the second shielding shells has a sleeve and a pair of pins, the sleeves are sleeved on the second protrusions, and the pair of pins are extended from the sleeve and inserted to the third inserting holes.

13. The electrical connector assembly as recited in claim 1, wherein the second body has a second side wall, the second side wall being extended from the second base, the second base having the second inserting holes, the second terminals passing through the second base and being surrounded by the second side wall.

14. The electrical connector assembly as recited in claim 13, wherein the second structural member further comprises a guiding rib located on the second side wall, and the guiding rib is guided by and engaged with a guiding groove of the first structural member such that the second body is inserted to the first structural member.

15. The electrical connector assembly as recited in claim 13, wherein the second structural member further comprises a clamping piece, disposed on the second base and extended and suspended on the second side wall, and the clamping piece and a bump of the first structural member are engaged with each other to hold the second body on the first structural member.

* * * * *